US010283868B1

(12) United States Patent
Breed

(10) Patent No.: US 10,283,868 B1
(45) Date of Patent: May 7, 2019

(54) TUNABLE PATCH ANTENNA

(71) Applicant: David S. Breed, Panama City, FL (US)

(72) Inventor: David S. Breed, Panama City, FL (US)

(73) Assignee: The United States of America as represented by the Secretary of the Navy, Washington, DC (US)

( * ) Notice: Subject to any disclaimer, the term of this patent is extended or adjusted under 35 U.S.C. 154(b) by 75 days.

(21) Appl. No.: 15/370,092

(22) Filed: Dec. 6, 2016

(51) Int. Cl.

| | |
|---|---|
| ***H01Q 1/48*** | (2006.01) |
| ***H01Q 9/04*** | (2006.01) |
| ***H01Q 1/42*** | (2006.01) |
| *H01Q 1/38* | (2006.01) |
| *H01Q 1/24* | (2006.01) |
| *H01Q 1/36* | (2006.01) |

(52) U.S. Cl.
CPC ..... *H01Q 9/0442* (2013.01); *H01Q 1/42* (2013.01); *H01Q 1/48* (2013.01); *H01Q 9/04* (2013.01); *H01Q 9/0485* (2013.01); *H01Q 1/243* (2013.01); *H01Q 1/36* (2013.01); *H01Q 1/38* (2013.01)

(58) Field of Classification Search
CPC H01Q 1/243; H01Q 1/36; H01Q 1/42; H01Q 1/38; H01Q 9/04
USPC ..... 343/700 MS, 702, 860, 872
See application file for complete search history.

(56) References Cited

U.S. PATENT DOCUMENTS

2004/0036660 A1* 2/2004 Huor ..... H01Q 21/0012 343/767
2006/0027777 A1* 2/2006 Koeneman ..... F16K 11/074 251/205
2007/0241969 A1* 10/2007 Andrenko ..... H01Q 1/38 343/700 MS

* cited by examiner

*Primary Examiner* — Hai Tran
(74) *Attorney, Agent, or Firm* — James T. Shepherd

(57) ABSTRACT

A tunable patch antenna includes a dielectric substrate having first and second surfaces. An electrically-conductive sheet is coupled to the first surface, and a patch assembly is coupled to the second surface. The patch assembly includes an electrically-conductive base fixedly coupled to the second surface and an electrically-conductive disk rotatably coupled to the substrate. The base has a substantially circular void wherein a perimeter region of the base circumscribes the void. The base has an electrically-conductive run extending from the perimeter region to a feedpoint location within the void. The disk has a diameter greater than a diameter of the void such that the disk is in contact with the perimeter region of the base. The disk has a slot cut through it that is aligned with a center of the disk.

19 Claims, 3 Drawing Sheets

TUNABLE PATCH ANTENNA

ORIGIN OF THE INVENTION

The invention described herein may be manufactured and used by or for the Government of the United States of America for Governmental purposes without payment of any royalties.

FIELD OF THE INVENTION

The invention relates generally to patch antennas, and more particularly to a patch antenna that can be tuned over a range of frequencies in a specific application environment.

BACKGROUND OF THE INVENTION

An antenna is a mechanical structure with an associated electrical behavior. Any change to its mechanical structure will affect its electrical performance. Since an antenna radiates energy, it interacts with nearby objects which has the effect of changing the antenna's mechanical nature, and hence, its electrical nature. Therefore, placing an antenna near objects, such as a metal surface, changes the resonant frequency of the antenna.

Patch antennas are ideal for many applications having restricted mounting locations due to their low profile. However, patch antennas are typically narrow-band. When a patch antenna is placed in tight quarters on or near metal surfaces or objects, the surrounding environment can cause a resonant frequency shift that can move the antenna's resonant frequency completely out of band. Currently, antenna designers compensate for this frequency change by customizing a patch antenna to its specific mounting location and environment. Each antenna's design is based on the size of the surface it is mounted to and the unique interference caused by its relative location to other objects. The uniqueness of most locations/environments can make the use of patch antennas costly.

SUMMARY OF THE INVENTION

Accordingly, it is an object of the present invention to provide a tunable patch antenna.

Another object of the present invention is to provide a patch antenna that can be readily tuned over a range of resonant frequencies at the antenna's installation location.

Other objects and advantages of the present invention will become more obvious hereinafter in the specification and drawings.

In accordance with the present invention, a tunable patch antenna includes a dielectric substrate having a first surface and a second surface. The first surface is parallel to the second surface. The substrate has a geometric center common to the first surface and second surface. An electrically-conductive sheet is coupled to the first surface of the substrate. A patch assembly is coupled to the substrate at its second surface. The patch assembly includes an electrically-conductive base fixedly coupled to the substrate's second surface and an electrically-conductive disk coupled to the substrate for rotation relative to the base. The disk is in contact with the base. The base has a substantially circular void passing through it wherein a perimeter region of the base circumscribes the void. The base has an electrically-conductive run extending from the perimeter region to a feedpoint location within the void and offset from the geometric center of the substrate. The disk has a diameter greater than a diameter of the void such that the disk is in contact with the perimeter region of the base. The disk has a slot cut through it that is aligned with a center of the disk.

BRIEF DESCRIPTION OF THE DRAWINGS

Other objects, features and advantages of the present invention will become apparent upon reference to the following description of the preferred embodiments and to the drawings, wherein corresponding reference characters indicate corresponding parts throughout the several views of the drawings and wherein.

DETAILED DESCRIPTION OF THE INVENTION

Figure 1:
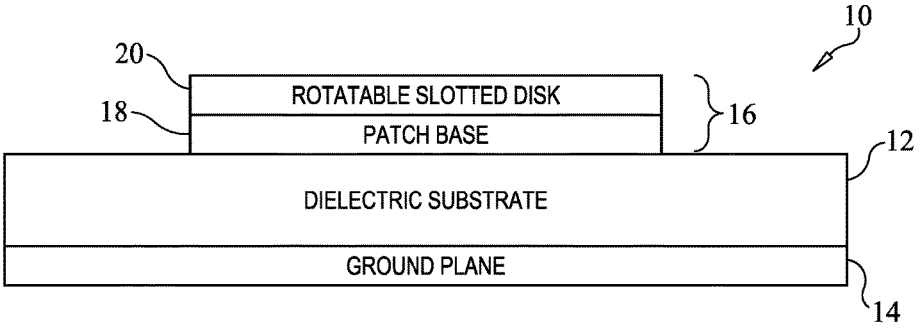
FIG. 1 is a schematic view of a tunable patch antenna in accordance with the present invention.

Referring now to the drawings and more particularly to FIG. 1, a tunable patch antenna in accordance with the present invention is shown and is referenced generally by numeral 10. In general, tunable patch antenna 10 includes a dielectric substrate 12, a ground plane 14 coupled to one side of substrate 12, and a patch assembly 16 coupled to the other side of substrate 12. As is known in the art, substrate 12 is a material that is not electrically conductive while ground plane 14 is an electrically-conductive material. Suitable materials for substrate 12 and ground plane 14, as well as their construction, are well understood in the art and will not be described further herein.

Patch assembly 16 provides the structure that allows antenna 10 to be tuned to a specific frequency over a range of frequencies. Patch assembly 16 includes a patch base 18 and a rotatable slotted disk 20. Both base 18 and disk 20 are made from an electrically-conductive material such as copper, although the particular choice of electrically-conductive material is not a limitation of the present invention. Base 18 is fixed to substrate 12. Disk 20 is in physical/electrical contact with base 18 and is rotatable with respect to base 18. By way of example and as will be explained later herein, disk 20 can be coupled to substrate 12 in a way that allows disk 20 to be rotated relative to base 18 and then fixed in a selected rotated position. As will also be explained further below, disk 20 includes a slot cut through it where the region defined by the slot is not electrically conductive. That is, the region defined by the slot is filled with a dielectric such as air. In general, disk 20 is rotated relative to base 18 to adjust the current distribution path along base 18 that, in turn, changes the resonant frequency of patch antenna 10.

Figure 2:
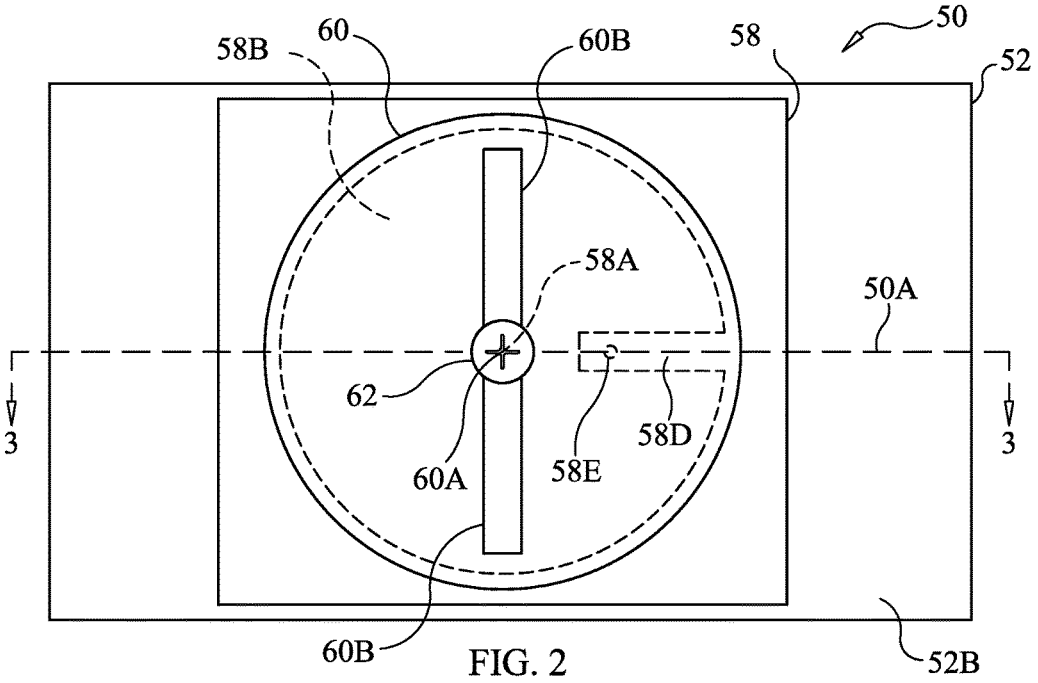
FIG. 2 is a plan view of a tunable patch antenna in accordance with an embodiment of the present invention.
Figure 3:
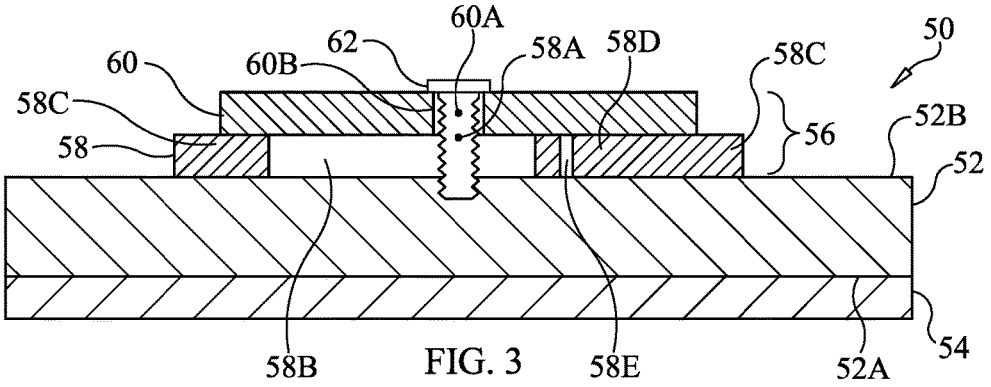
FIG. 3 is a cross-sectional view of the tunable patch antenna taken along line 3-3 in FIG. 2.
Figure 4:
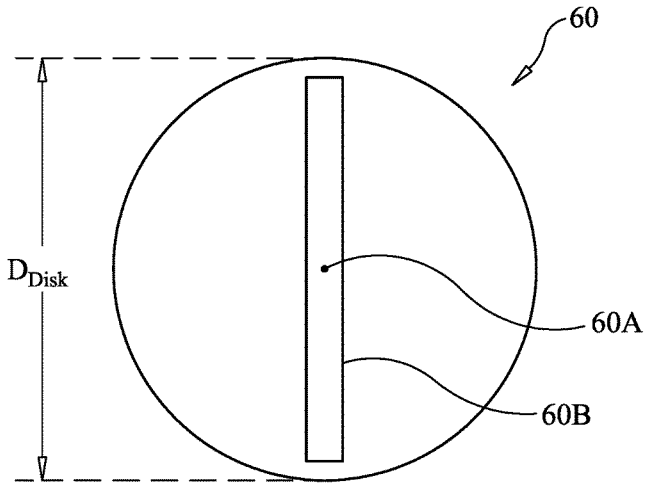
FIG. 4 is an isolated plan view of a patch disk in accordance with an embodiment of the present invention.
Figure 5:
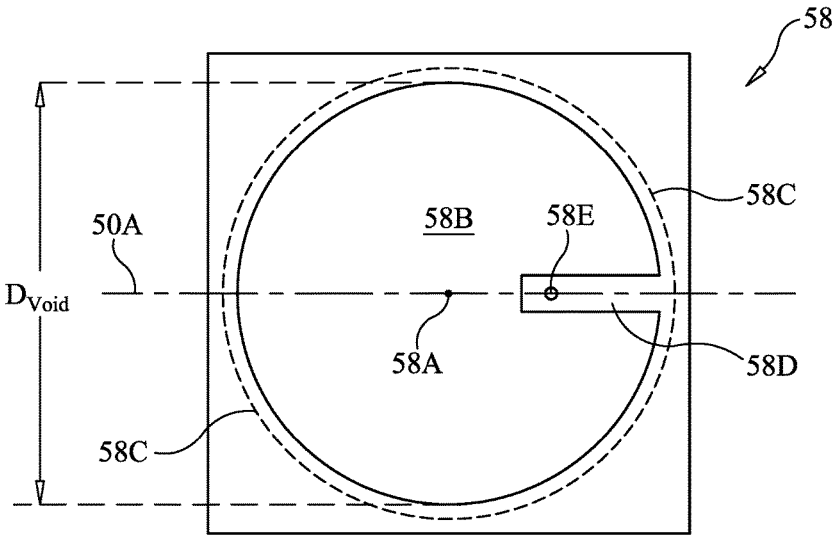
FIG. 5 is an isolated plan view of a patch base in accordance with an embodiment of the present invention.

An exemplary embodiment of a tunable patch antenna in accordance with the present invention will now be described with simultaneous reference to FIGS. 2-5. Briefly, FIG. 2 illustrates a patch antenna 50 in a plan view, FIG. 3 illustrates antenna 50 in a cross-sectional view, FIG. 4 illustrates a plan view of the antenna's rotatable slotted disk 60 in isolation, and FIG. 5 illustrates a plan view of the antenna's patch base 58 in isolation.

Patch antenna 50 includes a rectangular dielectric substrate 52, a rectangular ground plane 54 (only visible in FIG. 3), and a patch assembly 56. Substrate 52 is any known dielectric material having opposing and parallel planar surfaces 52A and 52B. Ground plane 54 is an electrically-conductive sheet of material (e.g., copper) that covers and is affixed to surface 52A of substrate 52. The material choices for substrate 52 and ground plane 54, as well as the fabrication thereof, are well known in the art.

Patch assembly 56 is coupled to surface 52B of substrate 52. Patch assembly 56 includes a patch base 58, a rotatable slotted disk 60, and a fastening screw 62. Patch base 58 is a rectangular electrically-conductive sheet of material (e.g., copper) that is affixed to surface 52B of substrate 52. As is known in the art of patch antenna construction, the geometric center 58A of patch base 58 is aligned with the aligned geometric centers of substrate 52 and ground plane 54. Typically, patch base 58 does not cover all of surface 52B. Patch base 58 has a substantially circular void or cut out region 58B (i.e., that is not electrically conductive) defined within the confines of patch base 58 such that a perimeter region of electrical conductivity is defined around void region 58B as indicated by the dashed-line circle 58C in FIG. 5. The electrically-conductive patch base 58 includes an electrically-conductive run 58D that extends from perimeter region 58C to a feed point location 58E within void region 58B. Feed point location 58E will have an antenna lead (not shown) coupled thereto as would be well understood in the art. Feed point location 58E is offset with respect to geometric center 58A of patch base 58. If patch antenna 50 is to be linearly polarized, feed point location 58E is located along a central longitudinal axis 50A of antenna 50 as illustrated in FIGS. 2 and 5.

Slotted disk 60 is a circular piece of electrically conductive material (e.g., copper) having a center 60A that is aligned with center 58A of patch base 58. Disk 60 has a diameter $D_{Disk}$ that is greater than the diameter $D_{Void}$ of void region 58B such that disk 60 makes electrical contact with all of perimeter region 58C when disk 60 is part of patch assembly 56. Disk 60 has a slot 60B cut through it that is filled with a dielectric material that can simply be air. The length and width of slot 60B can be used to control the tuning range of patch antenna 50. The width of slot 60B need only be wide enough to create a uniform non-conductive slot area such that any electric current in disk 60 must travel around slot 60B and not parasitically couple across slot 60B. Typically, slot 60B is symmetrically disposed about center 60A. The length of slot 60B and diameter $D_{Void}$ of void region 58B are to be less than the width of patch base 58. The following criteria can be used to maximize the tuning range of the antenna:

- the width of patch base 58 should be as wide as practical but less than the length of patch base 58; and
- the diameter $D_{Void}$ of void region 58B should be as large as is practical without exceeding the width of patch base 58 with the length of slot 60B being less than $D_{Void}$ of void region 58B. If needed, slotted disk 60 can be mounted on a dielectric material backer (not shown) for support.

Disk 60 is coupled to substrate 52 using fastening screw 62. More specifically, the shank of screw 62 passes through slot 60B and void region 58B, and is threaded into substrate 52. The head of screw 62 bears against disk 60. In this way, screw 62 is loosened to permit rotation of disk 60 relative to path base 58, and screw 62 is tightened to fix disk 60 relative to base 58. If used, the above-mentioned dielectric backer of disk 60 can be configured to also facilitate the coupling of patch assembly 56 to substrate 52 using fastening screw 62.

In operation, patch antenna 50 is positioned in its application location and screw 62 is loosened to provide for rotation of disk 60 relative to base 58. Disk 60 is then rotated to tune patch antenna 50 to a frequency in a range defined by the specific construction of antenna 50. The highest frequency in the antenna's range occurs when slot 60B is aligned with the antenna's central longitudinal axis 50A, while the lowest frequency in the antenna's range occurs when slot 60B is perpendicular to axis 50A. The change in resonant frequency results from the disruption of the current distribution along the length of patch base 58 caused by the position of slot 60B.

The advantages of the present invention are numerous. The patch assembly's slotted disk allows a patch antenna's resonant frequency to be readily tuned for a particular application location. Once tuned, the slotted disk is easily fixed to its tuned position thereby eliminating the need for a specifically-designed patch antenna.

Although the invention has been described relative to specific embodiments thereof, there are numerous variations and modifications that will be readily apparent to those skilled in the art in light of the above teachings. It is therefore to be understood that, within the scope of the appended claims, the invention may be practiced other than as specifically described.

What is claimed as new and desired to be secured by Letters Patent of the United States is:

1. A tunable patch antenna, comprising:

a dielectric substrate having a first surface and a second surface, said first surface being parallel to said second surface, said substrate having a geometric center common to said first surface and said second surface;

an electrically-conductive sheet coupled to said first surface;

a patch assembly coupled to said substrate at said second surface thereof, said patch assembly including an electrically-conductive base fixedly coupled to said second surface and an electrically-conductive disk rotatably coupled to said substrate for rotation relative to said base, said disk being in contact with said base;

said base having a substantially circular void passing through it wherein a perimeter region of said base circumscribes said void, said base having an electrically-conductive run extending from said perimeter region to a feedpoint location within said void and offset from said geometric center of said substrate; and said disk having a diameter greater than a diameter of said void wherein said disk is in contact with said perimeter region of said base, said disk having a slot cut through it, said slot aligned with a center of said disk.

2. A tunable patch antenna as in claim 1, wherein said slot is symmetrically disposed about said center of said disk.

3. A tunable patch antenna as in claim 1, wherein said slot is filled with a dielectric material.

4. A tunable patch antenna as in claim 3, wherein said dielectric material comprises air.

5. A tunable patch antenna as in claim 1, wherein a center of said void is aligned with said geometric center of said substrate, and wherein said center of said disk is aligned with said center of said void.

6. A tunable patch antenna as in claim 1, further comprising a screw passing through said center of said disk and threadably engaged with said substrate at said geometric center thereof.

7. A tunable patch antenna as in claim 1, wherein each of said substrate, said sheet, and said base is rectangular.

8. A tunable patch antenna, comprising:

a rectangular dielectric substrate having a first surface and a second surface, said first surface being parallel to said second surface, said substrate having a geometric center common to said first surface and said second surface;

an electrically-conductive sheet covering and coupled to said first surface;

a patch assembly coupled to said substrate at said second surface thereof, said patch assembly including a rectangular electrically-conductive base fixedly coupled to said second surface and an electrically-conductive disk rotatably coupled to said substrate for rotation relative to said base, said disk being in contact with said base;

said base having a substantially circular void passing through it wherein a perimeter region of said base circumscribes said void, said base having an electrically-conductive run extending from said perimeter region to a feedpoint location within said void and offset from said geometric center of said substrate; and said disk having a diameter greater than a diameter of said void wherein said disk is in contact with said perimeter region of said base, said disk having a slot cut through it, said slot aligned with a center of said disk.

9. A tunable patch antenna as in claim 8, wherein said slot is symmetrically disposed about said center of said disk.

10. A tunable patch antenna as in claim 8, wherein said slot is filled with a dielectric material.

11. A tunable patch antenna as in claim 10, wherein said dielectric material comprises air.

12. A tunable patch antenna as in claim 8, wherein a center of said void is aligned with said geometric center of said substrate, and wherein said center of said disk is aligned with said center of said void.

13. A tunable patch antenna as in claim 8, further comprising a screw passing through said center of said disk and threadably engaged with said substrate at said geometric center thereof.

14. A tunable patch antenna as in claim 8, wherein said feedpoint is aligned with a central longitudinal axis of said base.

15. A tunable patch antenna, comprising:

a dielectric substrate having a first surface and a second surface, said first surface being parallel to said second surface, said substrate having a geometric center common to said first surface and said second surface;

a rectangular ground plane coupled to said first surface;

a patch assembly coupled to said substrate at said second surface thereof, said patch assembly including a rectangular electrically-conductive base, an electrically-conductive disk, and a screw;

said base being fixedly coupled to said second surface, said base having a substantially circular void passing through it wherein a perimeter region of said base circumscribes said void, said base having an electrically-conductive run extending from said perimeter region to a feedpoint location within said void and offset from said geometric center of said substrate;

said disk having a diameter greater than a diameter of said void wherein said disk is in contact with said perimeter region of said base, said disk having a slot cut through it, said slot aligned with a center of said disk; and said screw passing through said center of said disk and threadably engaged with said substrate at said geometric center thereof wherein said disk is coupled to said substrate.

16. A tunable patch antenna as in claim 15, wherein said slot is symmetrically disposed about said center of said disk.

17. A tunable patch antenna as in claim 15, wherein said slot is filled with a dielectric material.

18. A tunable patch antenna as in claim 17, wherein said dielectric material comprises air.

19. A tunable patch antenna as in claim 15, wherein said feedpoint is aligned with a central longitudinal axis of said base.

* * * * *